US005513780A

United States Patent [19]

Buono

[11] Patent Number: 5,513,780

[45] Date of Patent: May 7, 1996

[54] UNITARY NOZZLE AND HANDLE COMBINATION

[75] Inventor: Caetano Buono, Staten Island, N.Y.

[73] Assignee: Van Blarcom Closures, Inc., Brooklyn, N.Y.

[21] Appl. No.: 253,666

[22] Filed: Jun. 3, 1994

[51] Int. Cl.[6] ..... A47G 19/00

[52] U.S. Cl. ..... 222/468; 222/475

[58] Field of Search ..... 222/468, 475, 222/481, 481.5, 545, 562, 551

[56] References Cited

U.S. PATENT DOCUMENTS

| | | |
|---|---|---|
| 653,944 | 7/1900 | Bultez . |
| 1,130,967 | 3/1915 | Boé . |
| 3,159,320 | 12/1964 | Scholtz . |
| 3,181,733 | 5/1965 | Marler . |
| 3,231,138 | 1/1966 | Serafini . |
| 3,235,147 | 2/1966 | Hamilton . |
| 3,307,752 | 3/1967 | Anderson . |

FOREIGN PATENT DOCUMENTS

| | | |
|---|---|---|
| 1050613 | 12/1966 | United Kingdom . |

*Primary Examiner*—Gregory L. Huson
*Attorney, Agent, or Firm*—Cohen, Pontani, Lieberman, Pavane

[57] ABSTRACT

A pressure insertable unitary nozzle and handle combination for interlocking insertion into a pair of spaced openings in the top of a container. Each opening is provided with an inwardly directed annular flange for securing the unitary nozzle and handle to the container. Accordingly, the unitary nozzle and handle is adapted to snap tightly over the spaced openings so as to provide a fluid-tight seal at these contact regions.

23 Claims, 6 Drawing Sheets

UNITARY NOZZLE AND HANDLE COMBINATION

FIELD OF THE INVENTION

This invention relates to a pressure insertable nozzle and handle combination formed of a single piece of material for interlocking insertion into a container.

BACKGROUND OF THE INVENTION

Pressure insertable plastic nozzle devices for openings in metallic containers and the like are known. Generally, the nozzle device is manufactured as a component separate from the handle and is force fitted into an opening in the container whereby a seal is effected by the radial sealing force exerted by the nozzle device against the edge of the opening in the container. However, prior art nozzle devices have suffered from a variety of drawbacks and deficiencies.

For example, U. K. Patent document 1,050,613 to Robinson discloses a nozzle that is inserted and locked into an opening in a container.

U.S. Pat. No. 653,944 to Bultez discloses a tap or nozzle fixed to the top of a receptacle by any suitable means, such as by screwing or soldering. The tap consists of a tubular body, a lateral orifice, a rotatable sleeve over the orifice, a spout projecting from the sleeve and a threaded portion for receiving a screw-type cap. To admit air into the receptacle through a perforation provided in the cap, a hollow air conduit extends from the tap at one end of the receptacle to the interior of the receptacle at the other end. The air conduit also serves as a handle for the container.

U.S. Pat. No. 3,159,320 to Scholtz discloses a container having two plugs, a nozzle and a vent plug mounted into the top of the container and connected by a metal handle. The ends of the handle are secured to the top of the container by the plugs. However, because this design employs a number of separate components which must be individually mounted onto the container, the design does not offer the advantages of simplicity, convenience and economies provided by the unitary structure of the present invention.

OBJECTS AND SUMMARY OF THE INVENTION

It is therefore an object of the present invention to provide a pressure insertable interlocking unitary nozzle and handle combination that provides an effective seal to prevent leakage of fluids which may otherwise cause rust and/or corrosion of the metal container.

Another object of the invention is to provide a pressure insertable interlocking unitary nozzle and handle combination which sealingly engages a pair of openings in the top of a container when inserted into the openings.

A further object of the invention is to provide such an interlocking unitary nozzle and handle combination having engagement means for securing the unitary structure to the container for preventing rotation of the structure relative to the container.

Still another object of the invention is to provide a nozzle and handle combination with simple structure made of a single component so that its production and assembly are minimized.

Yet another object of the invention is to provide a simple one-piece nozzle and handle combination which does not need to be welded to the metal container.

The present invention is thus directed to a unitary or one-piece pressure insertable interlocking nozzle and handle combination which can be mounted into spaced openings in the top of a typically metallic container. The nozzle and handle combination is mounted to the container in at least two places thereby providing a superior seal between the nozzle and handle structure and the container. Additionally, by providing a multiple engagement means between the container and the nozzle and handle assembly, torsional rotation of the structure relative to the container is prevented. Accordingly, leakage, rust and/or corrosion, as well as torsional rotation of the nozzle and handle structure relative to the container are minimized.

Specifically, the unitary structure of the present invention is suitable for use with a metallic container having openings with inwardly or outwardly directed annular flanges, although any type container having such inwardly or outwardly directed annular flange may be utilized. The unitary structure is provided with a nozzle portion, a handle portion and a flange member connecting the two. The nozzle is provided with a tubular neck body having a dispensing end and an opposed container end, the container end comprising a first engagement means for engagement with a corresponding opening in the container. The handle is provided with a grasping portion shaped as to be suitable for grasping by a user, a base portion, and a second engagement means extending outwardly from the base for engagement with a corresponding opening in the container. The length of the base portion may extend beyond the grasping potion. A flange member is disposed between the dispensing and container ends of the tubular neck body of the nozzle, thereby forming the unitary structure. The openings in the container are preferably formed so that they each have annular flanges circumscribing the opening.

The first engagement means further comprises a first collar that has an upper surface disposed so that when the nozzle portion is inserted into a corresponding opening in the container, the annular flange in the container's opening interlocks with the upper surface of the ridge member or collar to form a substantially fluid-tight seal between the container opening and the nozzle.

The second engagement means also comprises a second collar that has an upper surface disposed so that when the handle portion is inserted into the securement opening of the container, the annular flange interlocks with the upper surface of the second collar member to form a substantially fluid-tight seal between the container opening and the handle. Additionally, by providing this second engagement means, torsional rotation of the unitary structure relative to the container is prevented.

Assembly of the pressure insertable interlocking nozzle and handle structure into the openings of the container is simple. The unitary nozzle and handle structure, which is proportioned to fit snugly in the container openings, is oriented above the container openings and is press-fit inserted into the openings. As the nozzle and handle structure is inserted into the container openings, the engagement means lock or snap onto the annular flanges of the openings in the container. An efficient fluid tight seal between the container openings and the unitary structure is thereby assured in a simple and efficient assembly process.

Examples of suitable caps for engagement with the inventive nozzle and handle structure are screw-on type caps or bayonet lug-type caps. The pressure insertable interlocking nozzle and handle structure of the present invention may be formed of a plastic material, and the container—including the integral annular flanges—may be fabricated of a metallic material such as aluminum, stainless steel or galvanized metal.

These and other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE DRAWINGS

In the drawings, wherein like reference numerals identify similar elements throughout the several views.

DETAILED DESCRIPTION OF THE PREFERRED EMBODIMENTS

Figure 1:
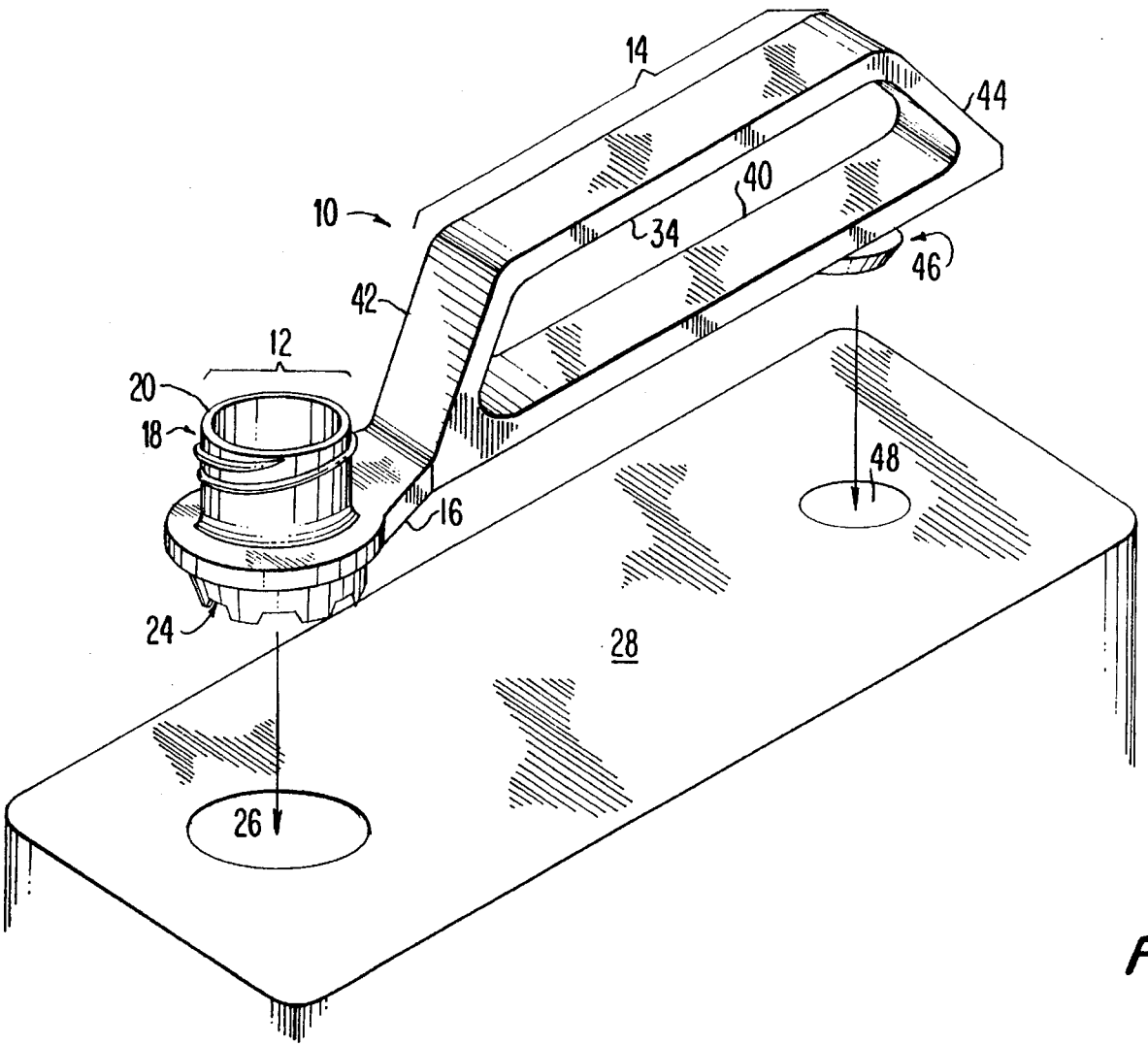
FIG. 1 is a perspective top view of the pressure insertable interlocking unitary nozzle and handle combination of the present invention.
Figure 2:
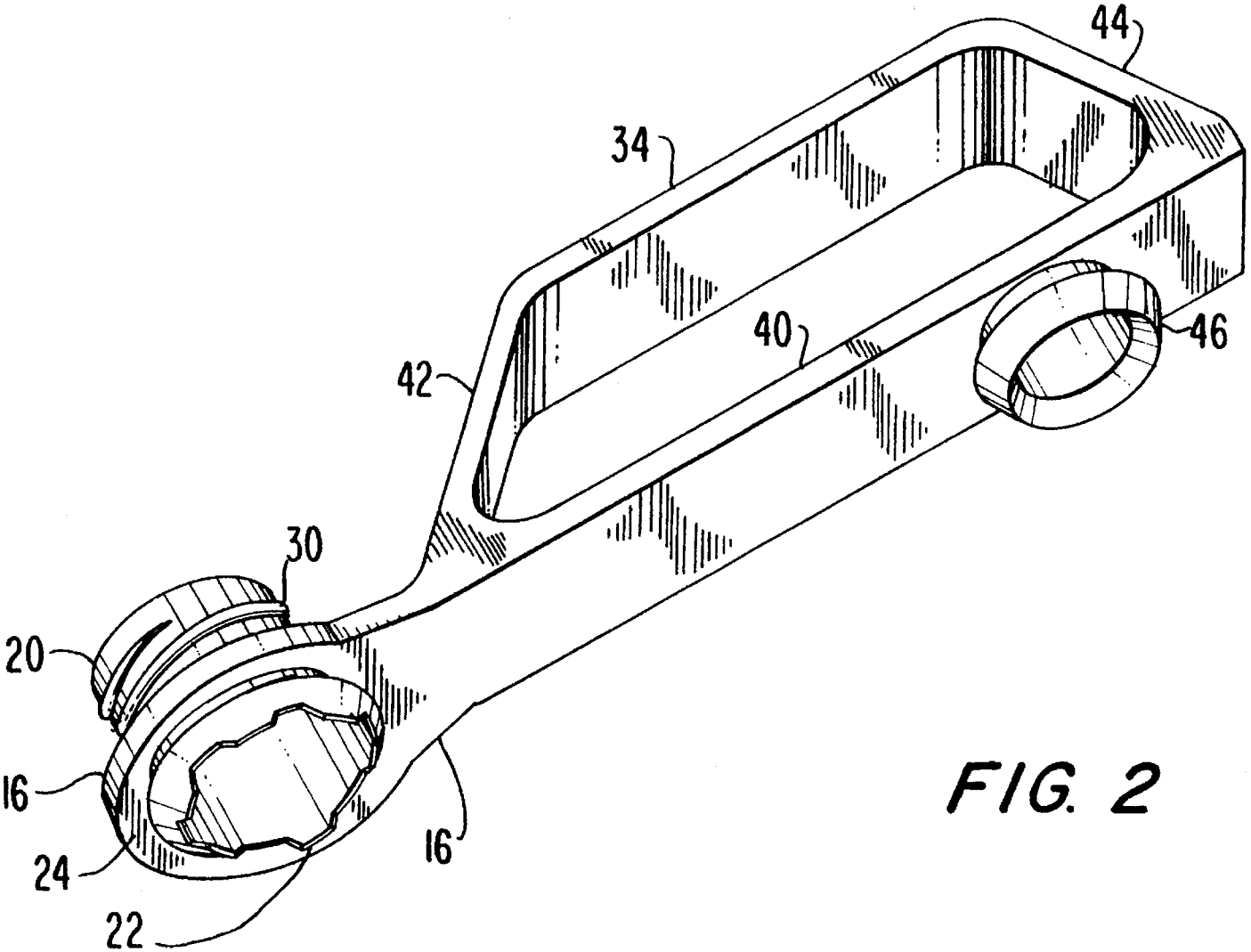
FIG. 2 is a perspective bottom view of the pressure insertable interlocking nozzle and handle combination of the present invention.

Referring to FIGS. 1–5 of the drawings, the pressure insertable interlocking nozzle and handle combination or unitary structure 10 of the present invention is provided with a nozzle portion 12, a handle portion 14 and an outwardly extending flange member 16 connecting portions 12 and 14. The nozzle portion 12 is provided with a tubular neck body 18 having a dispensing end 20 and a container end 22 which comprises a first engagement means 24 for engagement with a corresponding nozzle opening 26 in a container 28. The nozzle portion 12 is also provided with a threaded neck portion 30 at the dispensing end 20 for threaded engagement with a conventional threaded screw-type cap 32 or other suitable closing means known in the art.

The handle portion 14 is provided with a grasping portion 34 with two legs 42, 44 at opposite ends thereof, a base portion 40 connecting the legs 42, 44 and a second engagement means 46 which extends downwardly from the base 40 for engagement with a corresponding securement opening 48 in container 28. In this embodiment, the axis of the handle portion 14 is aligned with the nozzle portion 12.

The flange member 16 is connected to the tubular neck body 18 between the dispensing and container ends 20, 22, and connects the tubular neck body 18 to the base portion 40 of handle 14 thereby uniting the nozzle and handle portions 12, 14 to form a unitary structure.

Figure 3:
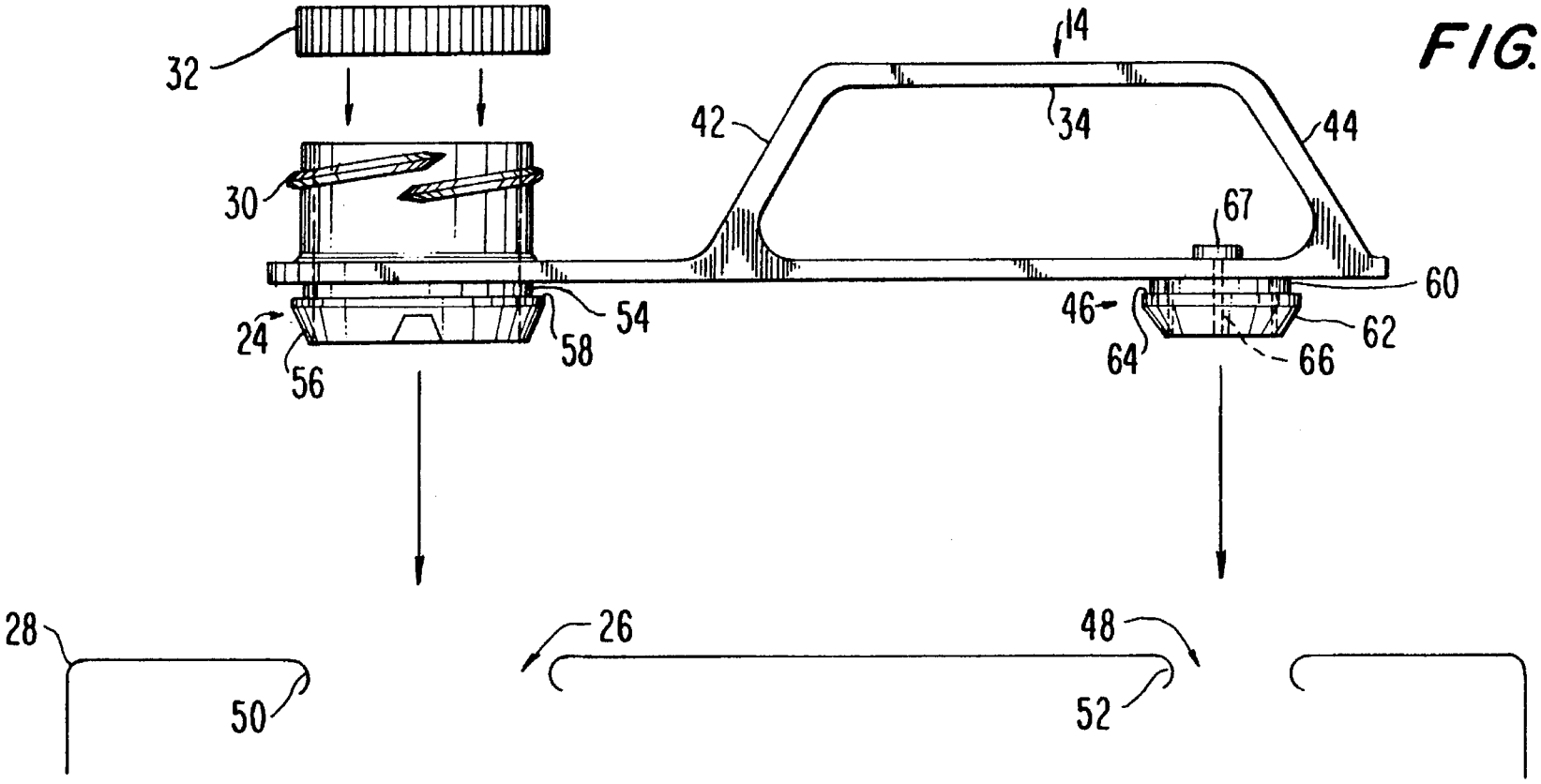
FIG. 3 is a side view of the pressure insertable interlocking nozzle and handle combination of the present invention shown proximate to the cross-sectional view of the container top with appropriately positioned openings.
Figure 4:
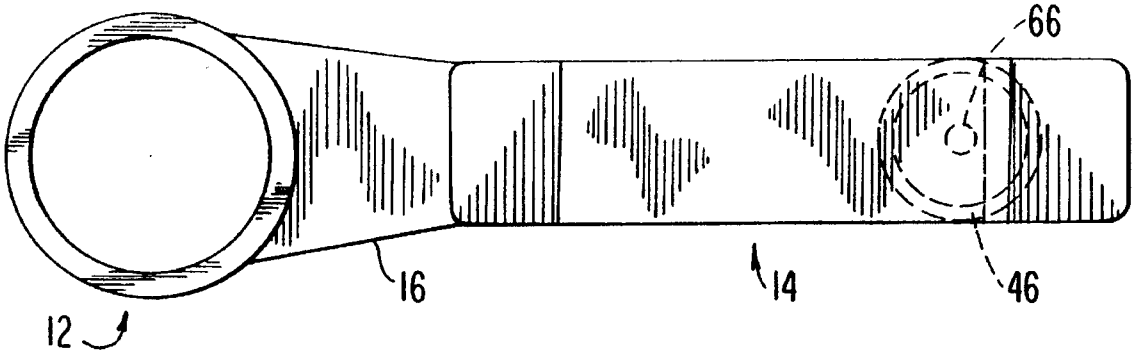
FIG. 4 is a bottom plan view of the pressure insertable interlocking nozzle and handle combination of the present invention.
Figure 5:
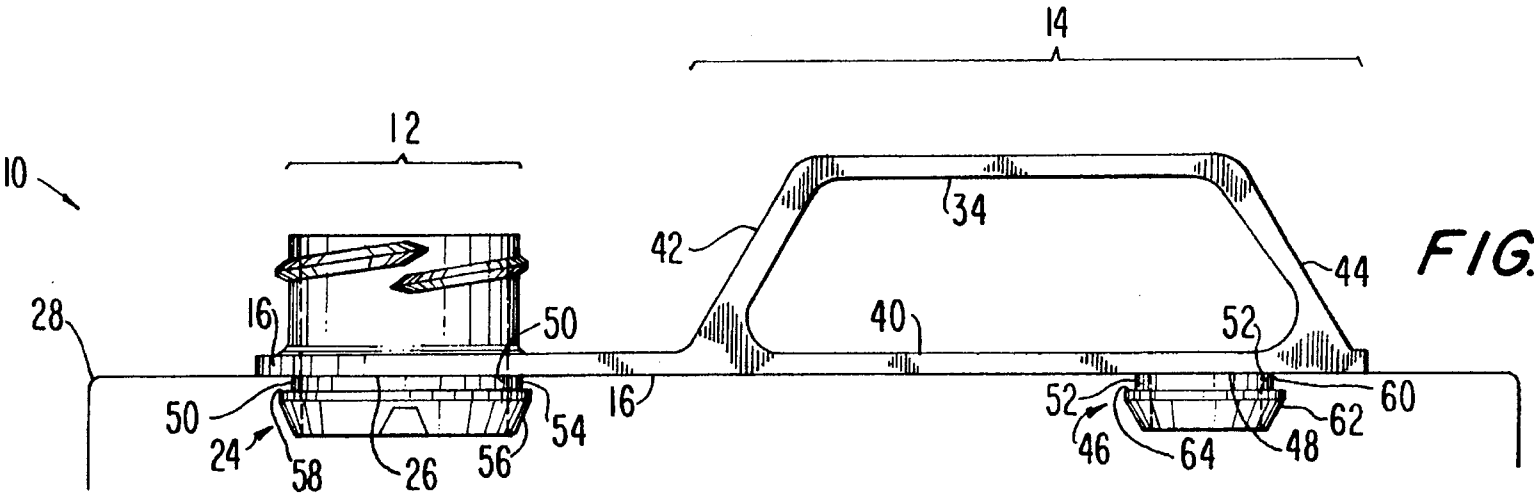
FIG. 5 is a side view of the pressure insertable interlocking unitary nozzle and handle combination of the present invention mounted onto a container.
Figure 7:
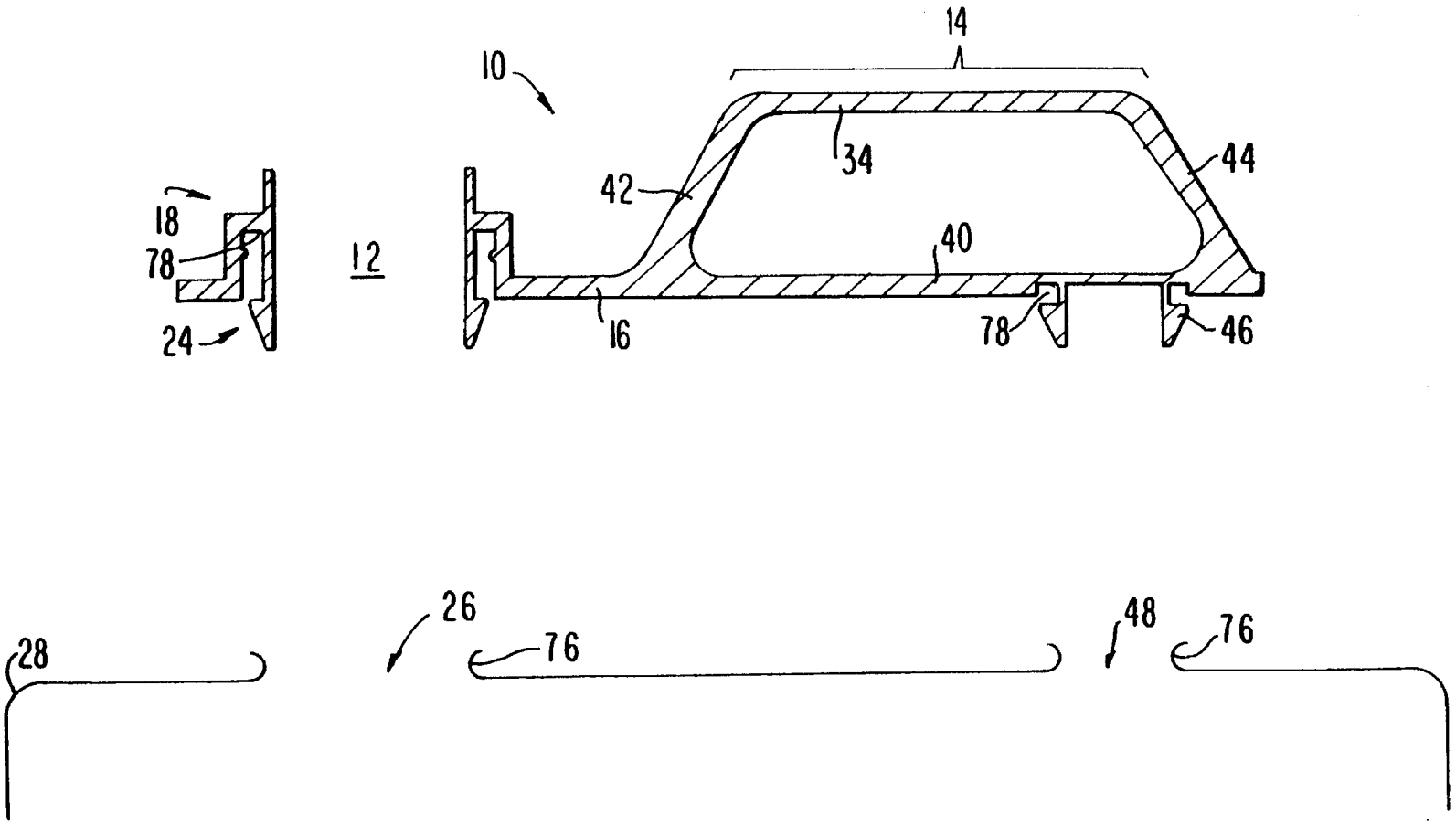
FIG. 7 is a cross-sectional side view of the pressure insertable interlocking nozzle and handle combination showing upwardly extending, annular flanges on the container.

The container 28, which is may be made of any material including a metallic material such as aluminum or galvanized steel, is provided with a pair of spaced openings 26, 48 which have inwardly extending annular flanges 50, 52 as shown in FIGS. 3 and 5. As well, the container may be provided with outwardly extending annular flanges 76 as shown in FIG. 7.

As shown in FIGS. 1, 2, 3 and 5, the first engagement means 24 comprises a downwardly projecting neck 54 integral with a first collar 56. This first collar 56 has an upper surface 58 disposed so that when the nozzle portion 12 is inserted into the corresponding nozzle opening 26 of the container 28, the annular flange 50 of the container 28 interlocks with the upper surface 58 of the collar 56 to form a substantially fluid-tight seal between the container opening 26 and the nozzle portion 12.

Figure 6:
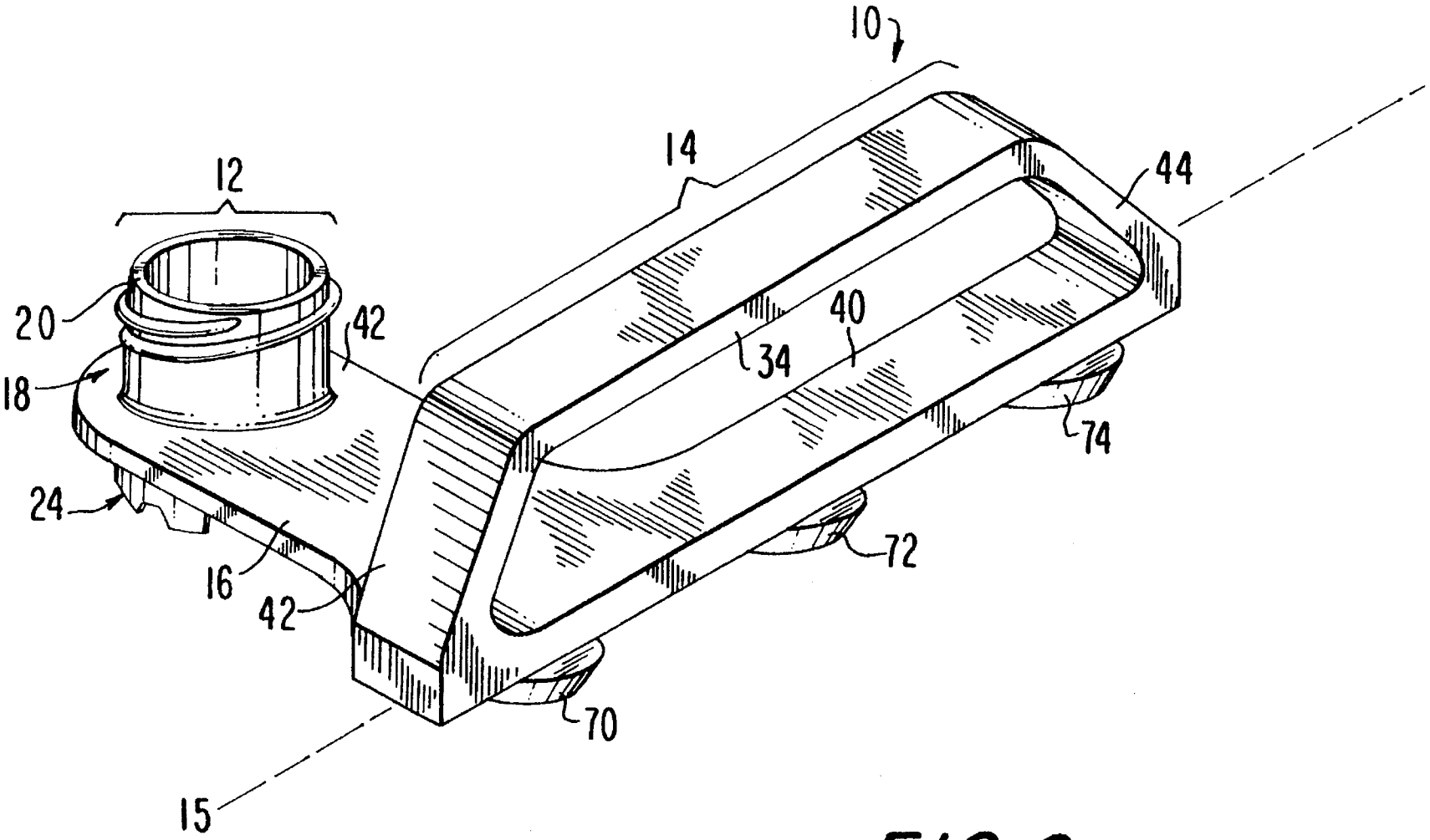
FIG. 6 is a perspective top view of another embodiment of the pressure insertable interlocking unitary nozzle and handle combination of the invention.

The second engagement means 46 also comprises a downwardly extending neck 60 and a collar 62. This second collar 62 has an upper surface 64 disposed so that when the handle portion 14 is inserted into the securement opening 48 of the container 28, the annular flange 52 interlocks with the tipper surface 64 of the second collar 62 to form a substantially fluid-tight seal between the container opening 48 and the handle portion 14. In the embodiment of the present invention shown in FIGS. 1, 2 and 5, second engagement means 46 acts as a plug to securement opening 48. Additionally, by providing this second engagement means 46, torsional rotation of the unitary structure 10 relative to the container 28 is prevented. Although the unitary structure 10 is shown in FIGS. 1 to 5 as having only one second engagement means 46 that attaches the handle portion 14 to the container 28, the unitary structure 10 may alternatively include additional second engagement means 70, 72 and 74 as shown in FIG. 6, which is discussed in detail below.

The unitary structure 10, which may be formed of plastic or any suitably resilient or compressible material, is proportioned to fit snugly in the container openings 26, 48. As shown in FIGS. 1 and 3, mounting of the unitary structure 10 onto a container 14 is accomplished by orienting the unitary structure 10 above the container openings 26, 48 and is then push-fit inserted into the openings 26, 48. As the unitary structure 10 is inserted into the container openings 26, 48, the annular flanges 50, 52 of the openings 26, 48 ride along the collars 56, 62 of the unitary structure 10 until the annular flanges 50, 52 lock or snap into abutment with the upper surfaces 58, 64 of the inwardly extending ridge members 56, 62 as shown in FIG. 5. In this manner, the annular flanges 50, 52 of the container openings 26, 48 are compressed against the necks 54, 60 of the engagement means 24, 46 and the upper surfaces 58, 64 of the collars 56, 62 to form a fluid tight, snug seal at the interface of the container 28 and unitary structure 10. To improve the fluid tightness of the seal between container 28 and unitary structure 10, resilient gaskets may be mounted oil the engagement means 24, 46 between the uniting structure 10 and the openings 26,48 in the container 28. These resilient gaskets may be a rubber or rubber like material or may be applied in liquid form as a caulking compound.

By attaching the unitary structure 10 to the container 28 in two places, loosening or tightening of the cap 32 will not cause the unitary structure 10 to rotate relative to the container 28, thereby and, in addition, the fluid-tight sealing engagement of the unitary structure 10 and container 28 is further enhanced.

In the embodiment of the present invention shown in FIG. 3, the base portion 40 of the handle 14 contains an aperture 66 which passes through the second engagement means 46 for admitting air into the container 28 to dissipate any vacuum therein and aid in the flow of fluid out of the container 28. In this embodiment, a cap 67 is preferably utilized to effectively seal the aperture 66. Alternatively, a one way valve may be substituted for the cap 67. The valve is mounted so that air can pass through the valve into the container but air and fluid cannot pass out of the container through the valve.

In the alternate embodiment of the unitary structure 10 of the present invention shown in FIG. 6, the handle portion 14 of the unitary structure 10 is not aligned with the nozzle portion 12 so that the unitary structure 10 is substantially L-shaped. The outwardly extending flange member 16 is substantially 90° relative to the axis of the handle portion 14. Alternatively, the nozzle portion 12 may be any other angle relative to the axis 15 of the handle portion 14. Additionally, the nozzle portion 12 may be connected proximate to the center of the handle portion 14 so as to form a T-shaped unitary structure. Similar to the embodiment shown in FIG. 1, the nozzle portion 12 is provided with a tubular neck body 18 having a dispensing end 20 and a container end 22 which comprises a first engagement means 24 for engagement with a corresponding nozzle opening 26 in a container 28. The handle portion 14 is provided with a grasping portion 34 with two legs 42, 44 at opposite ends thereof and a base portion 40 connecting the legs 42, 44. To securely mount the handle portion 14 to the container 28, three engagement means 70, 72, 74 are also provided which extend downwardly from the base 40 for engagement with corresponding securement openings (not shown) in the container 28. As is evident, any number of engagement means may be employed to facilitate securement of the unitary structure 10 to the container 28.

As shown in FIG. 7, the container 28 may be provided with annular flanges 76 which are integral with the container 28 and are outwardly extending. Similar to the embodiment described in FIG. 1, when the handle portion 14 is inserted into the securement openings 26, 48 of the container 28, the annular flange 76 interlocks with lower surfaces 78 of the collars 24, 46 to form a substantially fluid-tight seal between the container openings 26, 48 and the unitary structure 10.

It should be understood that the preferred embodiments and examples described are for illustrative purposes only and are not to be construed as limiting the scope of the present invention which is properly delineated only in the appended claims.

What is claimed is:

1. A combined nozzle and handle structure for insertion into a plurality of spaced openings in the top of a container comprising:

a nozzle having a fluid passageway therethrough and a first engagement means for interlocking and sealing engagement of said nozzle with said container top within a first of the plurality of openings in said top;

a handle having a grasping portion shaped for grasping by a user, a base portion fixedly attached to said grasping portion and disposed directly beneath said grasping portion, and a second engagement means extending from said base portion for interlocking and sealing engagement of said base portion with said container top within a second of the plurality of openings in the container; and a flange member connecting said nozzle and handle;

said nozzle, handle and flange member being formed from a single piece of material.

2. The nozzle and handle structure of claim 1, wherein said first and second engagement means comprise first and second collars, respectively, for engaging with the first and second openings, respectively, in the container.

3. The nozzle and handle structure of claim 1, wherein said nozzle further comprises a threaded neck portion at a dispensing end thereof for threaded engagement with a threaded screw-type cap.

4. The nozzle and handle structure of claim 1, wherein said structure is formed of a plastic material.

5. The nozzle and handle structure of claim 1, wherein the base of the handle further comprises an aperture extending through said second engagement means for the passage of air into the container.

6. The nozzle and handle structure of claim 1, wherein said handle is aligned with said nozzle and spout.

7. The nozzle and handle structure of claim 1, wherein said handle further comprises a third engagement means extending from said base portion for interlocking and sealing engagement of said base portion within a third of the plurality of openings in the container.

8. The nozzle and handle structure of claim 1, wherein said handle further comprises a fourth engagement means extending from said base portion for interlocking and sealing engagement of said base portion within a fourth of the plurality of openings in the container.

9. The nozzle and handle structure of claim 1, wherein said handle is not aligned with said nozzle and spout.

10. The nozzle and handle structure of claim 9, wherein said handle further comprises a third engagement means extending from said base portion for interlocking and sealing engagement of said base portion within a third of the plurality of openings in the container.

11. The nozzle and handle structure of claim 10, wherein said handle further comprises a fourth engagement means extending from said base portion for interlocking and sealing engagement of said base portion within a fourth of the plurality of openings in the container.

12. A container for fluids comprising:

a fluid tight vessel having a top wall with at least two openings therein, said openings being spaced apart from one another; and a combined nozzle and handle structure fixedly mounted on the outer surface of said top wall of said vessel, said combined nozzle and handle structure comprising:

a nozzle having a fluid passageway therethrough, a first engagement means interlockingly and sealingly engaged with said top wall within a first of the openings in the top wall of the vessel;

a handle having a grasping portion shaped for grasping by a user, a base portion fixedly attached to said grasping portion and disposed directly beneath said grasping portion, and a second engagement means extending from said base portion for interlocking and sealing engagement with a second of the openings in the top wall of the vessel; and a flange member connecting said nozzle and handle;

said nozzle, handle and flange member being integrally formed from a single piece of material.

13. The container of claim 12, wherein said first and second engagement means comprise first and second collars, respectively, for engaging with the first and second openings, respectively, in said vessel.

14. The container of claim 12, wherein said nozzle further comprises a threaded neck portion at a dispensing end thereof for threaded engagement with a threaded screw-type cap.

15. The container of claim 12, wherein said combined nozzle and handle structure is formed of a plastic material.

16. The container of claim 12, wherein the base of said handle further comprises an aperture extending through said second engagement means for the passage of air into the vessel.

17. The container of claim 12, wherein said handle is aligned with said nozzle and spout.

18. The container of claim 12, wherein said vessel has three openings and said handle further comprises a third engagement means extending from said base portion interlockingly and sealingly engaged within said third opening in the vessel.

19. The container of claim 18, wherein said vessel has a fourth opening and said handle further comprises a fourth engagement means extending from said base portion interlockingly and sealingly engaged within said fourth opening in said vessel.

20. The container of claim 12, wherein said handle is not aligned with said nozzle and spout.

21. The container of claim 20, wherein said vessel has three openings and said handle further comprises a third engagement means extending from said base portion interlockingly and sealingly engaged within said third opening in said vessel.

22. The container of claim 21, wherein said vessel has a fourth openings and said handle further comprises a fourth engagement means extending from said base portion interlockingly and sealingly engaged within said fourth opening in said vessel.

23. The container of claim 12, wherein said openings in said vessel have annular flanges.

* * * * *